United States Patent [19]

Arnemann

[11] Patent Number: 4,821,783

[45] Date of Patent: Apr. 18, 1989

[54] APPARATUS FOR FILLING CONTAINERS TO BE SEALED WITH PLUGS

[76] Inventor: Gerhard Arnemann, D-2083 Halstenbek, Am Krönrey 11, Fed. Rep. of Germany

[21] Appl. No.: 64,845

[22] Filed: Jun. 19, 1987

[30] Foreign Application Priority Data

Mar. 13, 1987 [EP] European Pat. Off. ..... 87103657

[51] Int. Cl.[4] ..... B65B 43/42

[52] U.S. Cl. ..... 141/165; 53/381 A; 53/282

[58] Field of Search ..... 141/1, 165, 166, 167; 53/109, 381 A, 281, 282

[56] References Cited

U.S. PATENT DOCUMENTS 2,731,185 10/1952 Banney et al. .
3,205,920 7/1962 Cozzoli et al. .
3,442,303 5/1969 Kellems ..... 141/165 X

FOREIGN PATENT DOCUMENTS 1817237 12/1968 Fed. Rep. of Germany .
2653608 11/1976 Fed. Rep. of Germany .
3301189 1/1983 Fed. Rep. of Germany .
0105197 8/1983 Fed. Rep. of Germany .
0065180 7/1984 Fed. Rep. of Germany .
2164029 3/1973 United Kingdom .

*Primary Examiner*—Philip R. Coe
*Assistant Examiner*—Joseph S. Machuga
*Attorney, Agent, or Firm*—Stanger, Michaelson, Reynolds, Spivak & Tobia

[57] ABSTRACT

In the disclosed apparatus, a belt feeds empty containers, into a filling station. At a waiting position in the station of the belt lifts a container with a support having centering rollers that permit horizontal displacement of the empty container while alignment pulleys engage the vertical sides of the container to the rotate the container about its vertical axis so that its fill opening is at the leading edge of the container. A horizontally rotatable plate above the container but ahead of the waiting position sequentially applies an unplugging device and a level sensor to the container. When the belt moves the container to the filling position and when filling device has filled the container, the plate swings the unplugging device around to the filling position and plugs the container's fill opening. Upon further rotation, it positions a second device to apply a safety cap to the container. According to an preferred embodiment, the plate also carries a re-centering pin that enters the opening in the waiting position and prealigns moves the container on the rollers with the filling device at the filling position.

7 Claims, 8 Drawing Sheets

APPARATUS FOR FILLING CONTAINERS TO BE SEALED WITH PLUGS

BACKGROUND OF THE INVENTION

The invention relates to an apparatus for the filling, particularly of a liquid or solid, flowable medium into containers, particularly drums or barrels sealed with screw plugs or otherwise constructed plugs, the screw plugs preferably being covered by slipped-on safety caps.

Apparatuses for the simultaneous filling of a liquid or solid, flowable medium into receptacles, such as containers, drums, packs or the like are known in a large number of different constructional forms.

EP-A-No. 0 105 197 discloses such a filling apparatus, which comprises a pipe system with a feed pump for the supply of the medium to be filled and with filling valves connected by means of supply lines above the receptacle to be filled. In each supply line leading to the filling valves is provided a volume chamber with an impeller arranged in its interior and which is rotated by the medium flowing to the particular filling valve. The impellers of all the volume chambers are rigidly interconnected by means of a mechanical shaft connected to a breaking means controllable by means of a system pressure-dependent control means. For the control of the filling valves there is a two-stage pneumatic control cylinder, which is directly connected with at least one filling valve and is connected to the other filling valves by means of an adjusting device. A control member is provided which responds to the weight of the filled medium by means of a balance associated with one of the filling valves is provided and is connected to the control cylinder. Such a filling apparatus makes it possible to simultaneously fill several receptacles, whilst it is only necessary to measure and monitor the filling volume or weight of a single receptacle.

U.S. Pat. No. 3,548,891 discloses a plant for the simultaneous filling of several receptacles, but using dosing and filling means in a number corresponding to the number of containers to be filled, an individual filling means being associated with each of the containers to be filled. The filling connections used in this plant make it possible to fill individual containers in accordance with the filling volume and this is made possible by a filling means being associated with each individual container. However, in the case of this filling means neither the filling volume, nor the filling weight of an individual container is measured and monitored, so that the filling of the containers is not controlled by means of the filling volume or weight of an individual container. In this filling plant, the filling volume or weight of each individual container is monitored and used for controlling the filling means.

U.S. Pat. No. 3,205,920 discloses a filling apparatus making it possible to fill with liquids containers moved passed several filling valves. The containers to be filled are supplied by means of a conveyor belt, whose forward movement is disconnected if the number of containers corresponding to the number of filling valves is located under the discharge openings of the latter. At this instant a link motion places all the filling valves simultaneously on the openings of the containers to be filled and simultaneously by means of pumps the filling valves are supplied with that liquid quantity which is to be filled into the containers. In order to ensure the uniform setting down of the filling valves onto the container openings, all said filling valves are fixed to a supporting beam, which is displaceable held in vertical guides. By means of the link motion, said supporting beam can be moved up and down with the filling valves. The filling valves are connected to the pump by means of flexible hose lines. In the case of said filling apparatus, once again all the containers are simultaneously filled with liquid using filling valves and by means of which dosing is simultaneously carried out.

Drums intended to be filled with liquids are, as is known, supplied with screwed down plugs. It is therefore necessary to remove the latter and then screw them down again after filling. Thus, the drums must be precisely aligned on the feed belt or the like of the filling means, because otherwise there is a risk that the material to be filled will flow down the drum and not into the bunghole.

For closing the filling opening of a drum or the like with a device for inserting and fixing a plug in said opening, DE-A-No. 18 17 237 discloses a closing or sealing device, in which both the device for inserting the plug and also a position determining device are so fitted in spaced manner that they can be freely moved up and down, as well as in accordance with polar coordinates with respect to a fixed point in a plane at right angles to the upwardly and downwardly directed movement. In addition, in said known device a gripping means is provided, in order to prevent the free movement of the devices for inserting the plug and for determining the position, together with a drive means able, when the gripping means prevents the free movement of the two devices for inserting the plug and determining the position, to move said two devices only linearly and in forced manner by a distance corresponding to the spacing between the two devices. This closing device has very large dimensions.

U.S. Pat. No. 2,731,185 discloses a plug screwing-in device with a centreing and screwing head, which comprises an outer centreing ring and a screwing head displaceable therein counter to spring tension, said head being connected by means of a drive shaft with angularly moveable joints to a drive means. In the case of this plug screwing-in device the centreing ring is constructed and profiled in such a way that on screwing in a plug into the bunghole of the drum it is supported on the upper all-round rim of the bunghole connection and therefore is adapted to the dimensions and diameter of said bunghole connection.

EP-A-No. 0 065 180 discloses a plug screwing-in device for drums having a centreing and screwing head, comprising an outer centreing ring and a screwhead located in its interior and displaceable against spring tension and which is connected to its drive means by means of a drive shaft having an angularly moveable joint. This plug screwing-in device comprises a supporting frame and an upper mounting plate and a lower mounting plate on which is arranged a centreing plate, which is provided with a cross-shaped opening and whose inner wall surface bounding the opening tapers conically towards the centreing and screwing head and passes at the bottom into a vertical wall section. The internal diameter of the recess defined by the wall section is larger than the diameter of the drive shaft. In the opening is placed a correspondingly profiled moulded or shaped body with an outer wall surface tapering conically in the direction of the centreing and screwing head. At its bottom end, the shaped body carries the centreing rings supported on the drum cover plate during the plug centreing and screwing-in process and is connected by a portion located on the centreing plate to a guide plate, which is held on at least three guide bolts fixed to the lower mounting plate of the supporting frame so as to be longitudinally displaceable and pivotable against the tension of springs. The drive shaft comprises a shaft part connected to the drive means and a shaft part carrying the screwing head, the two shaft parts being interconnected by means of a universal joint.

All the filling plants operate in the same way, namely following the alignment of the container to be filled by means of a screwing means, the screw plug is screwed out of the container filling opening, picked up and placed on a conveyor belt, which runs parallel to the feed path of the container to be filled. On said conveyor means the screw plugs removed from the screwing means and placed on the conveyor belt are brought into a new position parallel to the feed movement of the containers to be filled, in which the screw plug is screwed into the filling opening of the filled container and the screwing means for the screw plugs can also participate in this forward or advance movement if no second screwing means is provided. When the screw plug has been unscrewed, then the empty container is supplied on a conveying means to a filling station and dwells therein until the container has been filled with the corresponding filling material. The filled container then passes into the screw plug screwing-in position, where the screwing means is kept ready. In this position, it is simultaneously possible to supply safety caps, which by means of a corresponding mechanism are mounted on the screw plug screwed into the filling opening of the filled container. In such a filling plant there are three work cycles, namely in the first cycle the drum is aligned and the screw plug is unscrewed from the filling opening. Following a further advance of the thus prepared container, in the second work cycle the container is filled. Following a further advance of the filled container, in a third work cycle the filling opening is sealed by means of a screw plug and optionally the safety cap is fitted. A thus constructed and functioning filling plant has relatively large dimensions, even though satisfactory working speeds are achieved. In addition, the operating efficiency of such a filling plant is dependent on the filling time and the number of work cycles. Furthermore, there is no need in the case of such filling plants to align the containers with the screwing means and the filling means in a very accurate manner. An extremely accurate alignment or orientation of the containers is only necessary for fitting the safety caps on the already screwed in screw plugs.

SUMMARY OF THE INVENTION

The invention solves the problem of providing a filling means for containers, particularly drums, in which it is possible to perform within two work cycles the removal of the plug, the measurement of the moisture, the filling of the empty container, the insertion of the plug into the filling openings of the filled container and the fitting of safety caps, i.e. all these operations are performed in only two container positions. In addition, a compact construction of the overall apparatus with a limited overall length is achieved, so that it is possible to house the filling apparatus even in small rooms or areas.

This problem is solved by the characterising features of claim 1.

It is possible with a thus constructed filling apparatus to economically fill containers, particularly drums provided with screw plugs and to allow all the operations, such as the centreing of the container to be filled on the feed belt or path, the unscrewing of the plug from the filling opening, the insertion of a moisture measuring probe into the interior of the container, the filling of the container, the screwing of the plug into the filling opening of the filled container and the fitting of screw caps on the screwed on or in plugs in such a way that simultaneously the working station for the filling apparatus can deal with two containers, without a large number of work cycles being involved, in which the containers have to stay for the individual operations. In the case of such a filling apparatus there are only two cycles, namely the empty container supplied to the filling apparatus is prepared for filling and simultaneously the container in advance of the empty containers is sealed and provided with safety caps, so that after moving out the filled, sealed container, the prepared empty container virtually only has to be moved on by one cycle to pass into the vicinity of the swung in filling apparatus, so that then on reaching the said filling position by the prepared container, it is filled, sealed and provided with a safety cap and simultaneously a further empty container which has run in is prepared. As the empty, prepared containers do not have to cover long distances from the preparation station to the filling position, the filling apparatus has very small dimensions, i.e. it does not have a great length. The total length of the apparatus is at least twice the container diameter. Due to the fact that for the alignment or orientation of the individual containers, they are picked up by their bottom, all-round edge, no significant amount of force has to be used, because for turning the container it only has to be slightly raised from its base surface, i.e. from the chain conveyor belts. The turning of the container for alignment purposes about its longitudinal axis take place by means of alignment rollers or pulleys on the support and centreing pulleys on which the baseplate of the container is engaged. Due to the fact that the supporting and centreing pulleys are arranged on a circular line, in such a way that their bearing axes are radially directed and due to the fact that the supporting and centreing pulleys are longitudinally displaceable on their bearing axes, it is possible to centre and displace said pulleys towards the centre, so that for alignment purposes in the horizontal the container can be moved in all directions. Due to the fact that the container rests on the centreing and supporting pulleys, the bottom friction on the lifting frame is extremely small, so that a precise alignment of the container whilst simultaneously centreing the container filling opening is possible. It is particularly advantageous to use the supporting and centreing pulleys forming the sliding surface for the container and on which the latter is displaceable in all directions, without a large amount of force having to be exerted. It is also advantageous that following a rough centreing by means of the alignment pulleys, a precise or fine centreing on inserting the probe-like moisture measuring device can take place by means of the centreing pin of the container.

The gripping of the containers for alignment purposes on their bottom all-round rim gives the advantage that the container is gripped in its stablist position, i.e. in the area having the greatest inherent rigidity, so that there are no wall surface deformations through the gripping of the container, as is the case in the known apparatuses.

The operating devices for the container combined in the working station can be rotated about a vertical central axis in such a way that only very small distances have to be covered, the advance and return of the filling device taking place via the rotary disc or the screwing means. Only a single screwing means is used and this unscrews the screw plugs from the filling openings of the empty container supplied and screws in the screw plugs into the filling openings of the filled container; it merely being necessary to pivot the screwing means by 180°. The movement sequence of the filling device extends over a mush shorter pivoting range, because on pivoting the screwing means out of the screw plug unscrewing position into the screw plug screwing-in position, the filling device is in advance in such a way that it is only at a short distance upstream of the screwing means. However, on pivoting the screwing means back out of the screw plug screwing-in position into the screw plug unscrewing position only a short distance has to be covered for reaching the filling position, said distance being matched to the advance speed of the prepared empty container into the filling position and as the conveying path for the advance of the container in the vicinity of the filling device only has a very short length, it is ensured that, if the filling device has reached its filling position, the filling opening of the container to be filled will also be positioned below the filling device, whereas then the screwing means is above the revolving, empty container.

If safety caps are to be mounted on the screwed-in screw plugs, then a corresponding device is provided on the rotary disc of the working station, which enables the safety caps supplied to the filling means to be individually taken up and conveyed into the fitting position, which is the position where the container with its filling opening is located when said container is to be filled.

Further advantageous embodiments of the invention are characterised in the subclaims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 2:
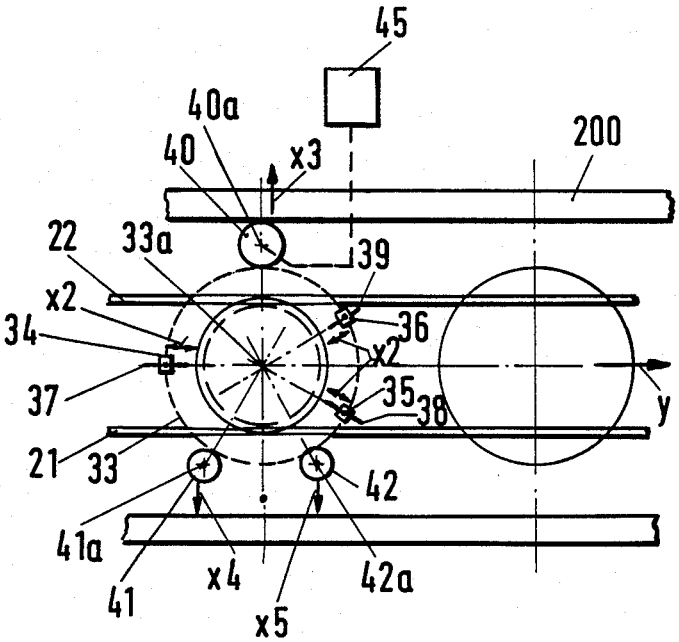
FIG. 2 a view from above of a portion of the conveying means for the filling means with the supporting and centreing pulleys and with a container mounted thereon with alignment pulleys engaging on the outer wall surface of the container.
Figure 3:
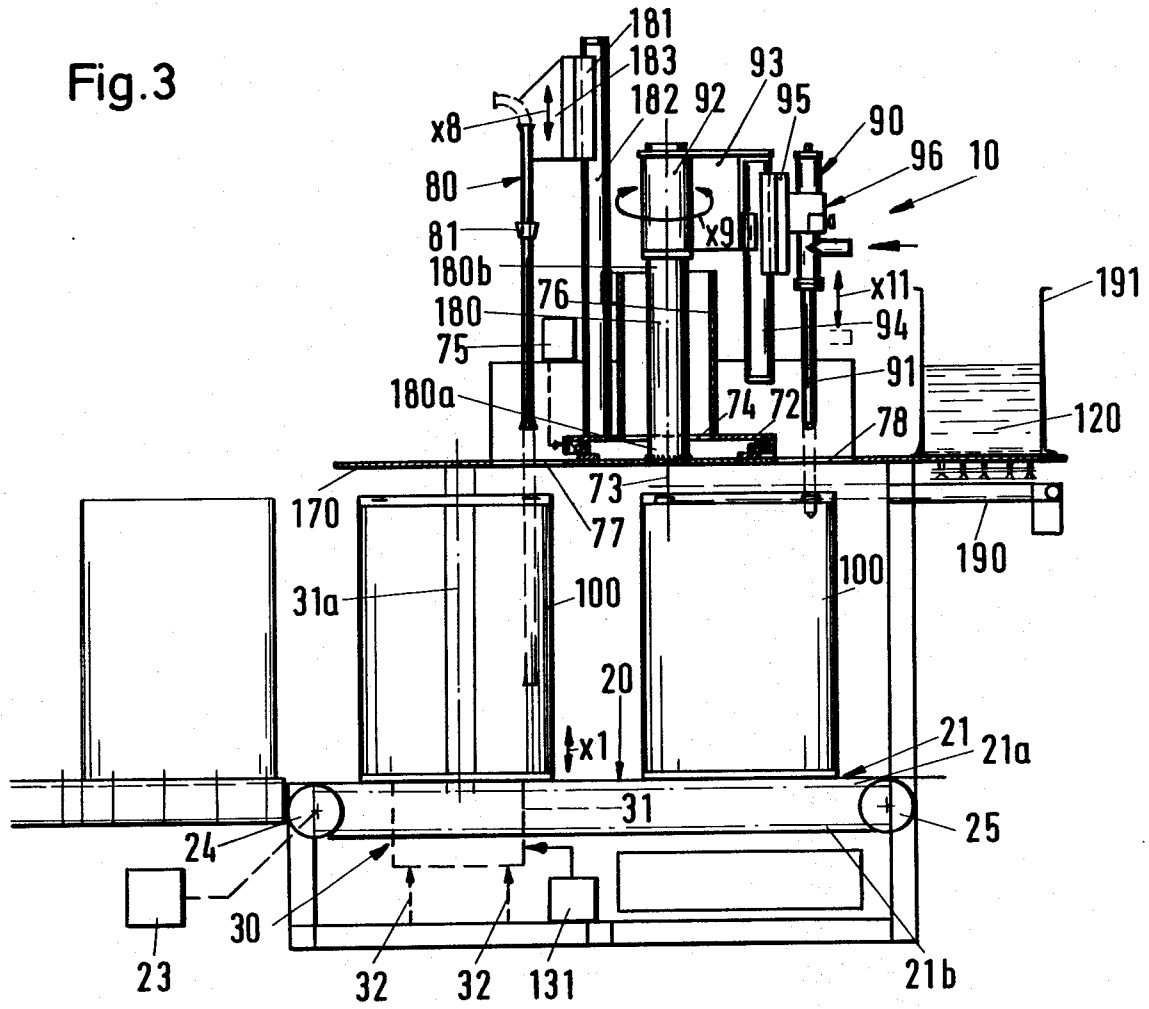
FIG. 3 partly in side view and partly in vertical section, the filling means with the working station in the working position in which the moisture measuring probe is introduced into the interior of the container and in which the container to be filled with its filling opening is located in the vicinity of the filling connection of the filling device.
Figure 5:
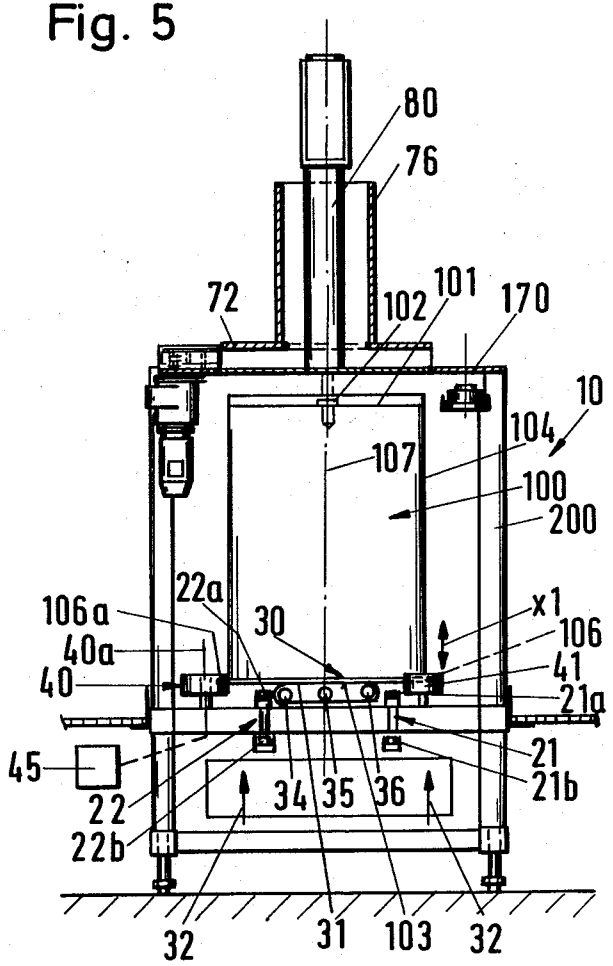
FIG. 5 a front view of the filling means.
Figure 4:
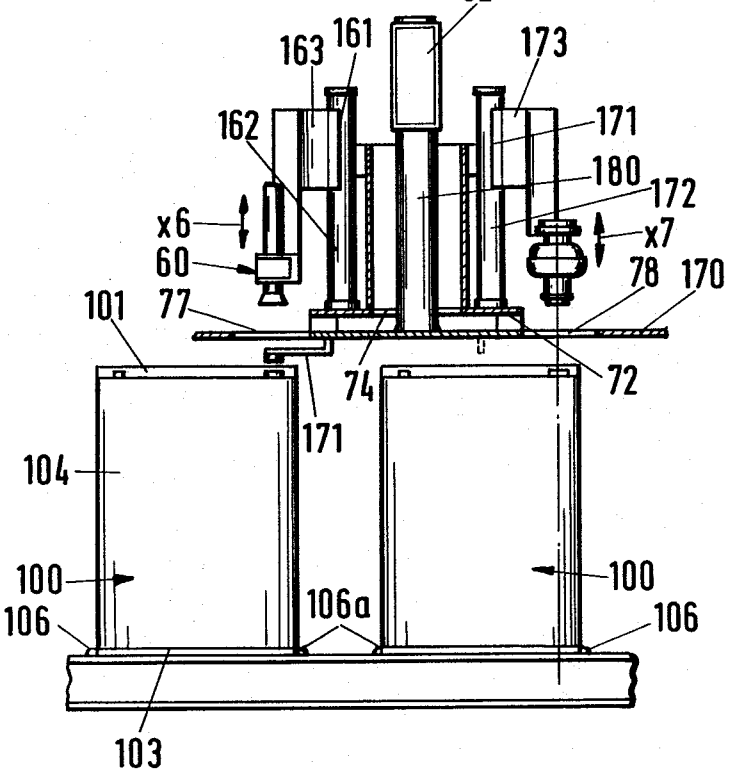
FIG. 4 partly in side view and partly in vertical section, the filling means with the working station in the working position in which the screwing means is located above the screw plug to be unscrewed and the device for fitting safety caps is located above the screwed-in plug of a filled container.

Apparatus 10 in FIGS. 1–5 for filling, in particular a liquid medium into containers, particularly drums closed or sealed with plugs comprises a horizontal conveyor belt or means 20 arranged in a machine frame 200 and on which are supplied the empty containers 100 sealed by means of the screw plugs 110. Upstream of conveyor belt 20 are provided further feed belts. In the same way, conveyor belt 20 are followed by further discharge belts, so that the length of conveyor belt 20 is limited exclusively to the region of filling means 10, the length of conveyor belt 20 at least corresponding to twice the diameter of a container or drum 100. Container 100 comprises the actual container body with container wall 104, an upper lid or coverplate 101, a filling opening 102 formed therein with an internal thread for screwing in a screw plug 110 made from metal or plastic, a base plate 103, an all-round, projecting edge 106 and an all-round rim 106*a*. The central container rotation axis is designated 107 (FIGS. 4 and 5).

Conveyor belt 20 is formed by two spaced, revolving or circulating chainbelts 21,22, which run in the direction of arrow X. The two chainbelts 21,22 are guided by means of corner pulleys not shown in the drawings and which are mounted in a machine frame 200 (FIG. 5), which receives the filling means 10. The drive of the chainbelts 21,22 takes place by means of driven corner pulleys, over which the chainbelts are guided. FIG. 3 shows the two corner pulleys of chainbelt 21 at 24,25. The upper sides of the two chainbelts 21,22 are designated 21*a*,22*a* and the lower sides 21*b*,22*b* (FIG. 5). The two chainbelts 21,22 are driven by means of a drive mechanism 23 which, in accordance with the individual operations, brings about the advance of an empty container and a filled container in the direction of arrow Y in such a way that in each case one empty container still closed by means of a screw plug is moved into the screw plug unscrewing position and after the filling position has been freed by removing a filled, sealed container, the first-mentioned, empty container without its screw plug is moved into the filling position. The conveying of the containers takes place cyclically and by means of a control mechanism not shown in the drawing it is possible to control the putting out of operation of the revolving chainbelts 21,22 and also the time during which the two belts 21,22 must remain out of operation in order to be able to perform the individual operations on the containers supplied to the filling means 10.

The filling means 10 also comprises a device 30 enabling the individual containers 100 to be raised slightly from the upper sides 21*a*,22*a* of the two chainbelts 21,22 (FIG. 5).

This device 30 comprises a lifting frame 31, which can be raised and lowered in the direction of arrow X1, said vertical movement of lifting frame 31 being brought about by means of the lifting equipment indicated by the arrows 32 in FIG. 5 and which can be driven hydraulically, pneumatically or electromotively.

The particular container 100 to be raised and aligned, is gripped by the lifting frame 31, which is positioned between the two chainbelts 21,22 or their upper sides 21a,22a and which picks up the container 100 to be raised and aligned on the all-round rim 106a of the container baseplate 103 or on the all-round, laterally projecting edge formed in the vicinity of said plate 103. Lifting frame 31 only performs a very small movement, because it is merely necessary to raise the container 100 from the upper sides 21a,22a of the chainbelts 21,22 put out of operation during the alignment process to enable container 100 to be so rotated about its longitudinal axis 107 by means of lifting frame 31 or alignment rollers or pulleys 40,41,42 that its filling opening 102 closed by a screw plug 105 is aligned with the screwing means 60 swung into the container advance path of the hereinafter described work station 50.

Device 30 also comprises at least three supporting and centreing rollers or pulleys 34,35,36 raisable together with the lifting frame 31 and positioned between the upper sides 21a,22a of the two chainbelts and which are located on a circular line indicated at 33 in FIG. 2. In the embodiment shown in FIG. 2, there are three supporting and centreing pulleys 34,35,36, on which the container 100 is supported, when it is grasped by lifting frame 31 and said container is rotated about its vertical central longitudinal axis 107 for alignment or orientation purposes. The diameter of the circular line 33, on which the three supporting and centreing pulleys 34,35,36 are located, roughly corresponds to the diameter of container 100. However, the circular line 33 can also have a larger or smaller diameter. It is important that the supporting and centreing pulleys 34,35,36 located on the circular line are so positioned that the container 100 to be aligned with its baseplate 103 is supported on said pulleys 34,35,36 (FIG. 5).

The arrangement of the three supporting and centreing pulleys 34,35,36 takes place in the manner shown in FIG. 2, i.e. the three pulleys are arranged between the upper sides 21a,22a of the two chainbelts 21,22, supporting and centreing pulley 34 lying in the container entry direction, whereas the two other supporting and centreing pulleys 35,36 are located on the portion of circular line 33 between the upper sides 21a,22a of the two chainbelts 21,22, said two supporting and centreing pulleys 35,36 then being located on the side remote from the entry direction for the container 100.

All three supporting and centreing pulleys 34,35,36 are arranged in overhung manner on bearing spindles or axes 37,38,39 located in the machine frame of filling means 10, all three bearing axes being radially directed to the vertical, roughly central container rotation axis 107, as can be seen from FIG. 2, i.e. the extensions of the three bearing axes 37,38,39 meet in the centre 33a of circular line 33. Each of the supporting and centreing pulleys 34,35,36 is, as a result of its overhung arrangement, freely displaceable on its bearing axis 37,38,39 in the bearing axis longitudinal direction, so that as a result of said displaceability the supporting and centreing pulleys 34,35,36 are automatically centred towards the centre 33a of circular line 33, so that a container 100 on the supporting and centreing pulleys 34,35,36 is displaceable horizontally in all directions, so that a fine centreing and alignment of the container with its filling opening is possible. The bearing axes or spindles 37,38,39 for the supporting and centreing pulleys 34,35,36 have corresponding lengths, so that the pulleys have an adequate displacement path. The free displaceability of the supporting and centreing pulleys 34,35,36 is indicated by arrow X2 in FIG. 2. Due to the fact that the lifting frame 31 grips the container 100 to be aligned in its bottom-side region, i.e. in the region having the greatest inherent rigidity and strength, no deformation of the container, particularly of its wall 104 takes place, so that filling means 10 can also be used for filling thin-walled containers 100.

In addition, device 30 has alignment rollers or pulleys 40,41,42, which are arranged in the circumferential region of the container 100 standing on the supporting and centreing pulleys 34,35,36, in such a way that the alignment pulleys are supported on the container outer wall surface 104 or on the all-round rim 106a of container baseplate 103, i.e. bear in said regions. It is particularly advantageous if the alignment pulleys 40,41,42 can also bear on the all-round edge 106 of container 100, because said container edge 106 has the maximum inherent rigidity and strength and can hardly undergo deformation if a pressure is exerted from outside on the all-round edge 106 (FIG. 4).

In the embodiment shown in FIG. 2, there are three alignment pulleys 40,41,42, whereof alignment pulley 40 is located outside chainbelt 22 and the two other alignment pulleys 41,42 are horizontally positioned outside chainbelt 21. The bearing axes or spindles 40a,41a,42a of the three alignment pulleys 40,41,42 are vertically positioned in the machine frame 200 of filling means 10. Of the three alignment pulleys 40,41,42, preferably alignment pulley 40 is driven in revolving manner by the drive mechanism indicated at 45, so as to be able to rotate container 100 about its vertical central axis 107. Container 100 is then supported on the two other alignment pulleys 41,42 during rotation, the container rotary movement being aided by the pulleys 41,42. All three alignment pulleys 40,41,42 can be swung in and out by means of mechanisms not shown in the drawing, such as support arms and the like and this takes place in the direction of arrows X3,X4,X5. Alignment pulleys 40,41,42 also permit a lateral alignment of container 100, in that the pulleys are brought into a position in which they bear on the container wall 104, or on the all-round, bottom edge 106 or the all-round bottom rim 106a of container 100. In the latter case lifting frame 31 is constructed in such a way that the engagement of the alignment pulleys is not impeded. The swinging-in position of the three pulleys 40,41,42 is such that during swinging-in of said pulleys for engaging on container 100, the latter is moved on supporting and centreing pulleys 34,35,36, whilst the container is simultaneously raised by means of lifting frame 31 from the upper sides 21a,22a of chainbelts 21,22. Lifting frame 31 is constructed in such a way that with its bottom-side, all-round edge 106 the container is so supported on lifting frame 31 that, on rotating container 100 about its central longitudinal axis 107, said container can move on lifting frame 31. The friction which occurs is extremely small, because the container weight is substantially supported on the three supporting and centreing pulleys 34,35,36 and due to the construction of the supporting and centreing pulleys is horizontally displaced thereon, said overall alignment of the container 100 taking place by means of alignment pulleys 40,41,42. Preferably the alignment pulleys are spring-loaded, so as to obtain an adequate contact pressure.

All components comprising the container raising means 30 can be brought together in a standard system, so that lifting frame 31, supporting and centreing pulleys 34,35,36 and alignment pulleys 40,41,42 are so arranged in a frame that all three components function in co-operating manner and permit a very precise alignment of the container.

The alignment pulleys 40,41,42 engaging on the all-round rim 106a or the all-round edge 106 of container 100 can be driven in revolving manner by using appropriate drive mechanisms, the rotation directions of all the alignment pulleys then being identical. The drive mechanisms for alignment pulleys 40,41,42 are combined in a control system not shown in the drawings and which co-operates with a scanning mechanism 171 to be described in greater detail hereinafter.

The devices for unscrewing the screw plug from the filling openings of the containers and for screwing the screw plugs into the filling openings of filled containers, for measuring the fill level in the container, for mounting or fitting safety caps and for filling the container with the particular substance are combined in a work station 50, which forms part of the filling means 10. The plug screwing-in and out device, which is constructed in per se known manner is designated 60, the device for fitting safety caps 70, the moisture measuring probe 80 and the filling device 90. All these devices 60,70,80 and 90 are constructed in per se known manner. Filling device 90 comprises a filling connection 91 (FIG. 3), which is connected by means of a dosing mechanism, not shown in the drawings, to a storage vessel, which contains the material to be filled. The supply of the safety caps 120 to device 70 for fitting said caps on the already screwed in screw plugs is designated 190 in FIG. 1. By means of said supply means 190, which can be constructed as a belt driven in revolving manner, the safety caps 120 are supplied from a storage container 191 to device 70 when the latter has been pivoted into the vicinity of supply belt 190 and assumes a position in which the individual safety caps are taken from device 70 and after transferring the latter into the fitting position place said caps on the screw plugs. The screw caps can be stacked in storage container 191. Unstacking of the individual safety caps takes place by a reversible screw cap fitter constructed in per se known manner and such as is also used for unstacking deep-drawn covers. The unstacking of the individual safety caps from the safety caps stacks can also take place by removing the individual caps. The individual caps can also be unstacked by unspindling with feed spirals.

Figure 1:
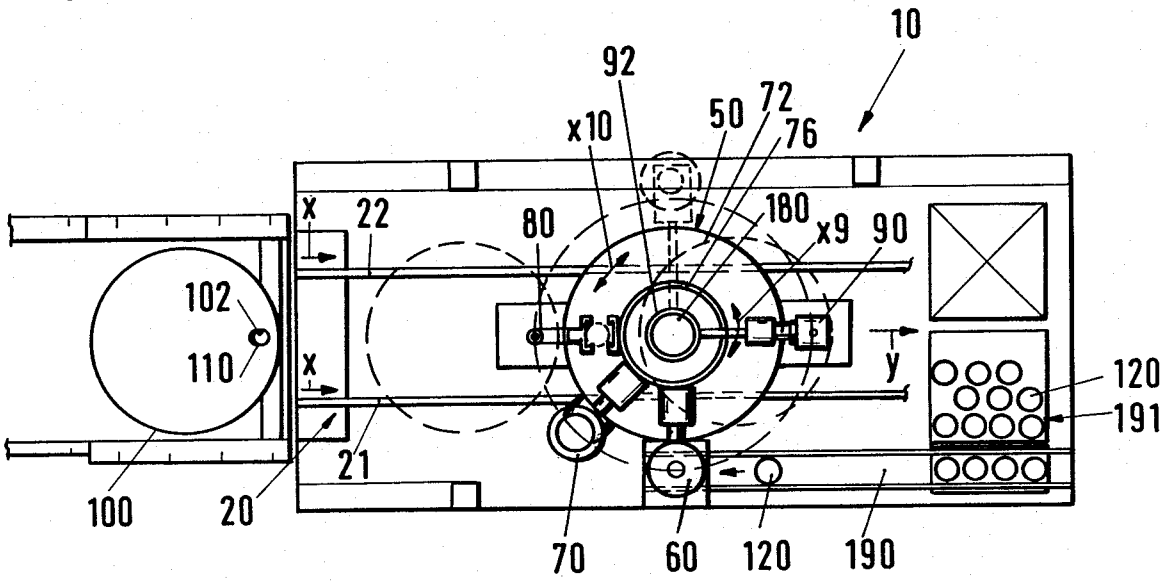
FIG. 1 a view from above of the filling means with its working station having a container in the screw plug unscrewing position and with a container in the filling position.

Devices 60,70,80 and 90 of work station 50 are combined on a supporting or mounting plate 170, which is spaced above the conveyor belt 20, the spacing between conveyor belt 20 and mounting plate 170 at least corresponding to the height of the container 100 to be filled, so that on the conveyor belt the containers 100 can be effortlessly moved under mounting plate 170. Mounting plate 170 is arranged in the machine frame of filling means 10 (FIGS. 1 and 3).

In the entry zone for the containers below mounting plate 170 is provided a scanning mechanism 171, which is constructed as a proximity switch, as a photoelectric element, such as e.g. a photoelectric cell or the like and is used for the control of the alignment pulleys 40,41,42. The empty container entering the filling means 10 with its screw plug still screwed into its filling opening is raised slightly from the conveyor belt 20 by means of lifting frame 31. The alignment pulleys 40,41,42 are then engaged on the all-round edge 106 or the all-round rim 106*a* of container 100. On putting the alignment pulleys 40,41,42 into operation, i.e. when said pulleys are rotated, container 100, which is on the one hand held by lifting frame 31 and on the other is supported by its baseplate 103 on the supporting and centreing pulleys 34, 35,36, with the aid of the scanning mechanism 171 is then so aligned with respect to its filling opening and brought into the position in which the filling opening of the container with the screw plug is located in the working area of the plug screwing-in and out device 60 or the moisture measuring probe 80, so that on lowering the screwing mechanism 60 its screwing head comes to rest on the screw plug of the container, grasps the same and unscrews it from the filling opening thread. This precise alignment of the container is controlled by means of the scanning mechanism 171.

On the top surface of mounting plate 170 is arranged a disc 72 rotatable about a vertical axis 73 and which is supported adjacent to its all-round rim on roller or antifriction bearings. Rotary disc 72 is rotated by means of a drive mechanism 75. The rotary disc 72 is centrally provided with an opening, preferably a circular opening 74 and in the vicinity thereof carries an upwardly extending support connection 76 constructed as a hollow cylinder (FIG. 4).

In the rotation zone of rotary disc 72 openings 77,78 are provided in mounting plate 170 and are used for receiving and the passage of devices 60,70,80,90 (FIGS. 3 and 4).

Rotary disc 72 carries the device 60 for unscrewing and screwing in the screw plugs, device 70 for fitting the safety caps and the moisture measuring probe 80. For the purpose of receiving said devices, rotary disc 72 carries vertical collar column-like guides 162,172,182, on which devices 60,70 and 80 are displaceable in the direction of arrows X6, X7 and X8. This movement of devices 60, 70, 80, on guide columns or posts 162,172,182 takes place by means of drive mechanisms not shown in the drawings. The guide posts 162,172,182 carry guide slides 161,171,181 with laterally projecting arms 163,173,183, on whose free ends are arranged devices 60,70, 80, so that in the case of a vertical movement of slides 161,171, 181 on posts 162,172,182 devices 60,70,80 participate in said movement. The two openings 77,78 in mounting plate 70 are arranged in such a way that, if the devices 60,70,80 are brought into their working positions by rotating rotary disc 72, the latter is aligned with said devices 60,70,80, so that the said devices can be passed through openings 77,78 in mounting plate 70. As shown in FIGS. 3 and 4, openings 77,78 in mounting plate 70 face one another, so that opening 77 faces the container entry region, whereas opening 78 is remote therefrom. Guide posts 162,172,182 can also be connected by means of connecting webs to the support connection 76 of rotary disc 72, which is advantageous for stabilisation purposes. If rotary disc 72 is rotated, devices 60,70,80 participate in said rotation.

In the vicinity of the vertical rotation axis 73 of rotary disc 72 is provided a further supporting column or post 180, which is arranged centrally with respect to rotary disc 72 and its bottom end 180a passes through the central opening 74 in rotary disc 72. Supporting column 180 is fixed by its bottom end 180*a* to mounting plate 170 and can consequently not participate in the rotation of rotary disc 72. Rotary disc 72 is annular and runs round the fixed supporting column 180. The latter is arranged in the interior of the hollow cylindrically constructed support connection 76 of rotary disc 72 and a portion 180*b* is led out of said connection 76.

Supporting column 180 carries a swivel 92, which is mounted or held in rotary manner in direction of arrow X9 about longitudinal axis 73 on said column 180 in the vicinity of the extended portion 180*b* thereof. Swivel 92 carries a laterally projecting arm 93, on which is arranged a vertical guide column 94, on which is arranged a guide slide 95 displaceable in the direction of arrow X11 and which carries the filling device 90 with filling connection 91. Guide slide 95 is connected to a drive mechanism not shown in the drawings, so that filling device 90 is longitudinally displaceable on guide column 94 by means of guide slide 95 (FIG. 3).

Guide columns 162,172,182 for devices 60,70,80 can also be an integral part of support connection 76 of rotary disc 72 or said support connection 76 can also be provided with corresponding guides on its outer wall surface, which then receive the guide slides 161,171,181 for devices 60,70,80.

As a result of this construction, only devices 60,70,80 participate in the rotary movement of rotary disc 72, because the filling device 90 is not connected to said disc and is instead held on supporting column 180, which is fixed to mounting plate 170. In this way filling device 90 is rotatable about the vertical longitudinal axis 73 independently of the rotary movement of rotary disc 72. For this purpose there is a mechanical coupling between rotary disc 72 and filling device 90, in that the latter is moved out of its filling position on rotating rotary disc 72 and said movement either takes place clockwise or counterclockwise, as a function of the rotation direction of rotary disc 72, which rotates in the direction of arrow X10. This mechanical coupling of filling device 90 with rotary disc 72 can take place by means of a cam mechanism, such as cams, which are not shown in the drawings, in such a way that if the screwing mechanism 60 is pivoted by means of rotary disc 72, then the filling device 90 is in front or behind.

Figure 6:
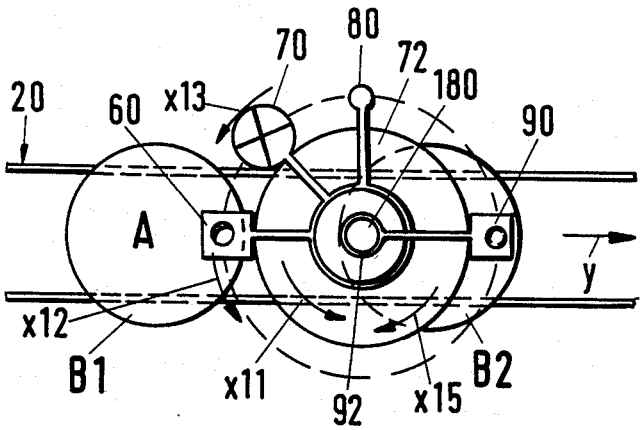
FIGS. 6–10 diagrammatic views from above of the operation and working sequences of the individual devices of the work station of the filling means.
Figure 7:
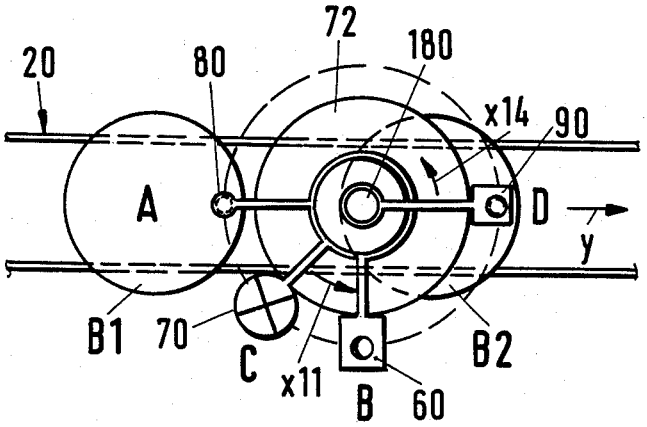

The reciprocal arrangement of devices 60,70,80,90 is such that when the screwing means 60 assumes the position shown in FIG. 6, then the filling device 90 assumes a position opposite to screwing means 60, whereas the two other devices 70,80 are located between screwing means 60 and filling device 90, in such a way that on rotating rotary disc 72 in the direction of arrow X11 screwing means 60 is also moved in the direction of arrow X12 out of the plug unscrewing position. This movement of screwing means 60 is followed by the device 70 for fitting the safety caps and even in the case of a rotation of rotary disc 72 in the direction of arrow X11 device 70 is moved in the direction of arrow X13. If device 70 assumes the position shown in FIG. 7, then the moisture measuring probe 80 assumes the position shown in FIG. 7 above the filling opening of a ready empty container. During these movements of the devices 60,70,80, filling device 90 remains in the position shown in FIGS. 6 and 7 until the container is filled and at the end of the filling process the screwing means 60 has been so further rotated by means of rotary disc 72 that said screwing means is located above the filling opening of the filled container. During this advance movement of the screwing means 60 into the screw plug screwing-in position, filling device 90 is pivoted out of its filling position in the direction of arrow X14, i.e. filling device 90 is in advance with respect to the leading screwing means 60 and then assumes the position shown in FIG. 8, when screwing means 60 is made to coincide with the filling opening of the filled container.

Filling means 10 functions as follows. A container B1 is introduced to such an extent on conveyor belt 20 that said container comes to rest below work station 50. By means of lifting frame 31 the container is slightly raised from the upper sides 21*a*,22*a* of the chainbelts 21,22 of the stationary conveyor belt 20, lifting frame 31 grasping the all-round edge 106 or the bottom all-round rim 106*a* of the container. Simultaneously the container is supported on the supporting and centreing pulleys 34,35,36 raised together with the lifting frame 31, whereby said pulleys can be an integral part of lifting frame 31. Alignment pulleys 40,41,42 are then engaged on the all-round edge 106 or the all-round rim 106*a* of the container, alignment pulley 40 already constituting the lateral boundary during the alignment process for the container, i.e. said pulley 40 constitutes a fixed stop. This is followed up by the two other alignment pulleys 41,42 in such a way that the container comes to rest between alignment pulleys 40,41,42 (FIGS. 2 and 5). If alignment pulleys 40,41,42 or only alignment pulley 40 are driven, then the container is so rotated and displaced about its longitudinal axis 107 until its filling opening 102 with the screw plug 110 still in the filling position assumes the position shown in FIG. 1 below the rotary disc 72 and below the front opening 77 in mounting plate 70. The complete alignment process is controlled by means of scanning mechanism 170 and corresponding control elements, not shown in the drawings, in which are brought together all the drive mechanisms of the work station devices. The individual operating sequences are then controlled in the necessary order by said control elements or the control mechanism.

The thus prepared, roughly aligned container B1 assumes the position shown in FIG. 6 below the work station 50. It is assumed that when carrying out a continuous filling process, a container B2 has been introduced prior to container B1 and has assumed the position of FIG. 6 before B1, whereby said position is the filling position.

When container B1 has assumed the position shown in FIG. 6, then rotary disc 72 is rotated in the direction of arrow X11 until the screwing means 60 has assumed position A and in this position comes to rest above the screw plug of empty container B1. Screwing means 60 is lowered with its screwing head onto the screw plug of container B1. The screw plug is grasped and by means of a rotary movement about a vertical axis is unscrewed from the thread of the filling connection bounding or forming the container filling opening.

Screwing means 60 then moves upwards and takes with it the unscrewed screw plug. This is followed by a further sectionwise rotation of rotary disc 72 in the direction of arrow X11, so that the screwing means is moved out of position A in the direction of arrow X12. If screwing means 60 is further moved in the direction of arrow X12, this is followed by device 70, the movement of the latter being indicated by arrow X13. Rotary disc 72 is rotated until the moisture measuring probe 80 has assumed the position indicated at A in FIG. 7. Screwing means 60 and device 70 between screwing means 60 and moisture or fill level measuring probe 80 then assume the positions indicated at B and C. Filling device 90 remains in its filling position above the filling opening of container B2, because filling device 90 does not participate in said rotary movements of rotary disc 72. By means of the moisture measuring probe the moisture in container B1 is determined. On said probe 80 is arranged a re-centreing pin 81, which surrounds probe 80 and which when the probe 80 is inserted precisely re-centres the filling opening or bunghole of the empty container.

During this process the alignment pulleys 40,41,42 are disengaged from the container rim, so that the container can move freely on the supporting and centreing pulleys 34,35,36. Re-centreing pin 81 with the external diameter precisely fits into the container filling opening. In this position lifting frame 31 is lowered and places the container is aligned form on chainbelts 21,22. However, the moisture measuring probe 80 can also be eliminated. In this case only the re-centreing pin 81 is provided and takes the place of moisture measuring probe 80, being automatically inserted in the container filling opening by corresponding drive means.

Figure 8:
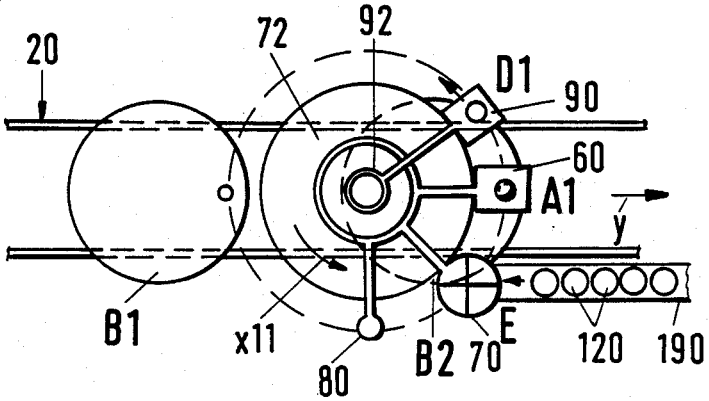
Figure 9:
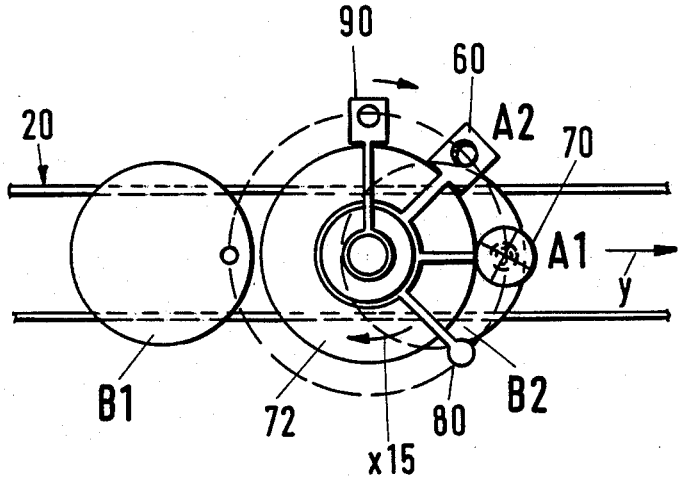

Rotary disc 72 is then further rotated in the direction of arrow X11, so that screwing means 60 comes to rest in position A1 in FIG. 8 above the filling opening of filled container B2. During the pivoting of means 60 from position B (FIG. 7) into position A1 (FIG. 8), due to the mechanical coupling filling device 90 is pivoted out of its filling position D in FIG. 7 until it has assumed position D1 in FIG. 8. The screw plug unscrewed from container B1 is still in the screwing means and following the lowering of the latter onto the filling opening of container B2 is inserted and screwed into said opening. When the filled container is closed or sealed, there is a further rotation of rotary disc 72 in the direction of arrow X11, so that the screwing means 60 is moved out of position A1 and then remains in position A2 (FIG. 9). As the other devices 70 and 80 are connected to rotary disc 72, said two devices participate in the rotary movement of disc 72 and are pivoted into the position shown in FIG. 9 until device 70 reaches the position A1 in FIG. 9, following the reception by device 70 in position E in FIG. 8 of a safety cap supplied on feed belt 190. With said received safety cap, device 70 is pivoted out of position E (FIG. 8) into position A1 (FIG. 9). When device 70 has assumed position A1, then device 70 is lowered and simultaneously the safety cap is mounted on the screw plug.

Figure 10:
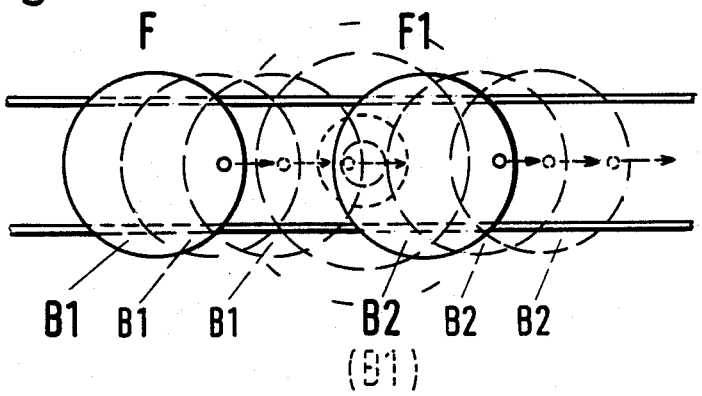

Container B1 with the unscrewed plug is again lowered on to conveyor belt 20 following the unscrewing process. When container B2 is filled, the screw plug screwed-in and the safety cap fitted, by putting into operation conveyor belt 20, container B2 is moved out of the filling means 10 and simultaneously container B1 is moved from position F into position F1 (FIG. 10) and consequently assumes the position of container B2 in FIG. 6. Simultaneously a new container B3 enters the means, to take up the position F of container B1 in FIG. 6. The rotary disc is simultaneously clockwise rotated and takes with it all the devices connected therewith. The rotary disc is rotated to such an extent that the screwing means 60 assumes position A1 in FIG. 6, after the newly introduced container B3 has been aligned in the aforementioned manner. If container B1 has taken up position F1 (FIG. 10) and new container B3 is in position F, the conveyor belt 20 is put out of operation, container B3 is aligned and its screw plug unscrewed. Simultaneously container B2 is filled, because the filling device 90 has assumed the position shown in FIG. 6, because when the rotary disc 72 returns in the direction of arrow X15, due to the mechanical coupling of filling device 90 with rotary disc 72, filling device 90 follows screwing means 60 and assumes the position shown in FIG. 6 when screwing means 60 has reached position A.

As a result of the construction and operation of filling means 10, it is possible in a single working stage to prepare an empty container for filling and to simultaneously fill the other container. The control of the device of work station 50 can also be such that filling device 90 is pivoted to such an extent that, if screwing means 60 assumes the position above container B2 (FIG. 8), the filling device comes to rest above the filling opening of container B1 and the filling process takes place here, so that after moving out the filled, sealed container B2, the already filled container B1 can be moved into the previous position of container B2, so that in this position it can be sealed following a corresponding rotation of rotary disc 72. Simultaneously a new container is introduced into the filling means, but can only be prepared when the screw plug has been screwed into the filled container and the screwing means 60 has moved into position A (FIG. 6).

The sequence of the process for the preparation of a container for filling and the filling process are matched to one another in such a way that the shortest times are maintained. During the filling process for an empty container, rotary disc 72 is turned to such an extent that screwing means 60 is located alongside filling device 90, whilst the already introduced, aligned and prepared container B1 is in the waiting position and is moved in place of container B2 when the filling process is ended, the screw plug screwed in and the safety cap fitted. If the screwing means 60 has assumed its position alongside filling device 90, then a long pivoting or swing path is no longer required in order to move the screwing means 60 into the position in which the screw plug is screwed into the filling opening of the filled container. The filling device 90 is then simultaneously moved out of its filling position and is returned thereto when screwing means 60 has been moved back out of position A1 in FIG. 8 into position A of FIG. 6.

The leading or trailing movement or in fact the pivoting of filling device 90 need not take place by means of a mechanical coupling with rotary disc 72 or screwing means 60. Thus, it is possible to rotate the rotary ring 92, which carries the filling device 90, by means of a drive mechanism, whereby the control of the latter can take place via the rotary movement of the rotary disc or the pivoting of screwing means 60. If e.g. rotary disc 72 or screwing means 60 has reached a given position, then the drive mechanism for swivel 92 can be put into operation by means of a control cam and this e.g. pivots filling device 90 out of filling position A1 into an adjacent position D1, so that screwing means 60 can take up position A1 (FIG. 8).

In the case of containers, whose filling openings are sealed by means of screw plugs, use is made of the screw plug unscrewing and screwing up device 60. However, if in place of screw plugs press-in plugs are used, then the means 60 will have a corresponding construction to enable the plug to be drawn out of the container filling opening and to be pressed into the same by means of pressure.

Figure 11:
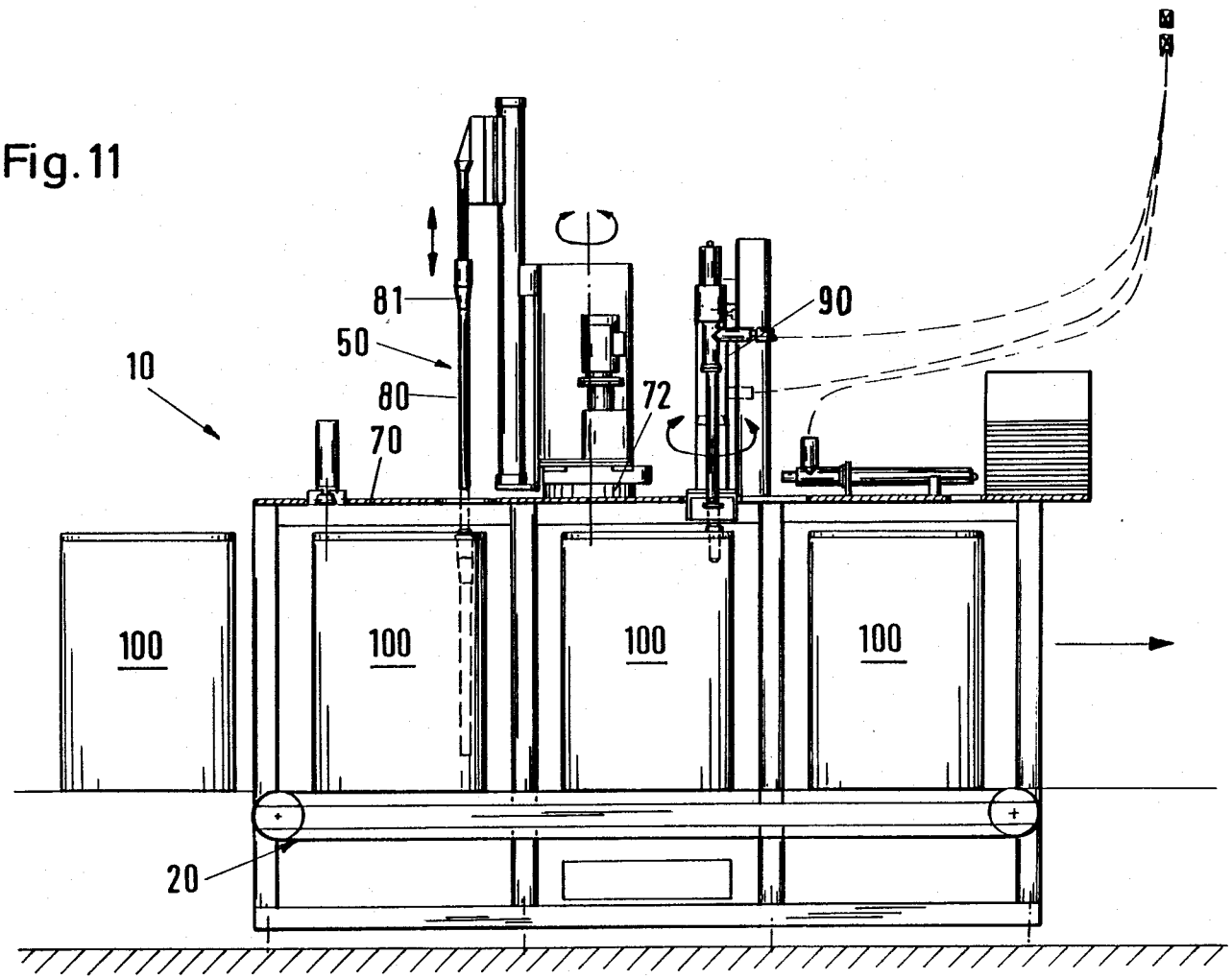
FIG. 11 in side view another embodiment of the filling means with a laterally pivotable filling device.
Figure 12:
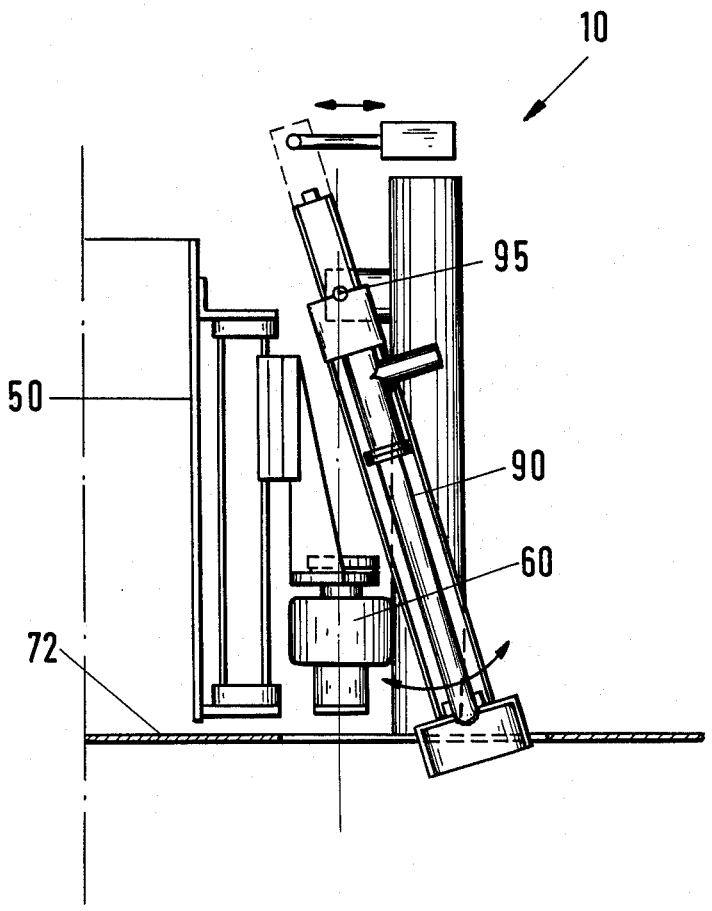
FIG. 12 a side view of the laterally pivotable filling device.

In the filling means embodiment shown in FIGS. 11 and 12, filling device 90 is not part of the work station and connected to support column 180 and is instead fixed to the machine frame of the filling means so that it can be laterally swung in and out. Filling device 90 does not then participate in the rotary or partial rotary movements of devices 60,70,80 and is instead arranged in stationary manner in the given filling position and at the end of the filling process is laterally swung out of the revolving path of rotary disc 72 or in movement path of devices 60,70,80. The fulcrum is indicated at 95 in FIG. 12.

What is claimed is:

1. Apparatus for filling containers each having an opening for receiving a screw plug and each having an outer periphery and a vertical axis as well as a given maximum horizontal dimension and as a maximum height, comprising:

(a) a horizontal conveyor belt for moving the containers and having a length at least twice the maximum horizontal dimension of a container, said conveyor belt including two spaced endless chainbelts, having upper sides to guide the containers, (b) means for raising the individual containers from the chainbelts between the upper sides of the two chainbelts, said means including:

(b1) a powered raisable and lowerable lifting frame for engaging the individual containers in the region between the two chainbelts, (b2) at least three container supporting and centreing pulleys raisable and lowerable with the lifting frame between the upper sides of the two chainbelts along a circular line with a center and a diameter at least corresponding to the maximum horizontal dimension of the container said centering pulleys having bearing axes extending radially relative to a vertical axis and substantially radial to the vertical container axes, the supporting and centreing pulleys being freely displaceable on their bearing axes in the longitudinal direction of said bearing axes and being automatically centreing towards the centre of the circular line, so that a container standing on the supporting and centreing pulleys is horizontally displaceable in all directions and (b3) three alignment pulleys with vertical bearing axes in the region of the periphery of the container when the container is standing on the supporting and centreing pulleys and engageable on the container periphery, means for rotating at least one of said alignment pulleys one of said pulleys forming a fixed lateral boundary stop for the container, the two other alignment pulleys facing said first alignment pulley and having bearing spindles, and means to permit swinging all three alignment pulleys into and out of engagement with the outer periphery of the container, (c) A work station having screwdriving means for screw plugs and a level measuring probe as well as a filling device, the work station comprising (c1) a horizontal mounting plate above the conveyor belts a distance greater than the height of the container, a scanning mechanism below said plate for detecting the screw plugs of an empty container and for controlling the alignment pulleys to center each empty container on the lifting frame above the container feed belt, (c2) a rotary disc, a drive mechanism for rotating the rotary disc about a vertical axis on the mounting plate, said rotary disc having a central opening a vertical support connection running upwards from the plate along the opening, a plurality of vertically displaceably guides mounted on the rotary disc one of said guides having a first laterally projecting arm for carrying said screwdriving means and another of said guides having a second laterally projecting arm, a device for fitting safety caps mounted on said second arm, the mounting plate having two facing openings arranged centrally with respect to the feed path for the passage of said devices, and (c3) a supporting column passing through the interior of the support connection and through the opening in the rotary disc, said supporting column having a longitudinal axis and a bottom end fixed to the mounting plate, a swivel rotatable about the supporting column along the longitudinal axis of the supporting column and having a third laterally projecting arm, a vertical guide with a vertically displaceable guide slide on said third arm, a filling device coupled to said guide slide and having a filling connection, a swivel on the filling device coupled with a forward or return movement of the rotary disc or the screwdriving means to make the filling device lead during an advance of the rotary disc or screwdriving means in a counterclockwise direction and to make the filling device trail behind during return movement of the rotary disc or the screwdriving means, the screwdriving means being arranged near the container opening in an initial position for facing the filling device while the device for fitting safety caps and the level measuring probe are positioned between the screwdriving means and the filling device in an angular range of 45° or 90° eminating from the means, and said station being arranged for aligning an empty, screw plug-equipped container which has entered the station with the screwdriving means in a position to unscrew the screw plug, lowering said screwdriving means onto the screw plug and unscrew it and raise it from the container opening, then rotate the rotary disc until the level measuring probe is aligned with the container opening, lowering the measuring probe into the container to simultaneously bring about coincidence between the filling device and the filling opening of the empty container, feeding the filling material into said container with said filling device, then moving the filling device away from the opening and rotating the rotary disc so the screwdriving means is aligned with the opening of the filled container and screws a plug onto the filled container, further moving of the rotary disc, following a screw plug being screwed into the opening of the filled container, to move the rotating means moves out of the position at which the screw plug is screwed in, moving the device for fitting a safety caps into the vicinity of the screwed in screw plug of the filled container and fitting a safety cap onto the screw plug of the filled container, moving filled and sealed container out of the station and an empty container into the station to a rearward filling position with simultaneous rotation of the rotary disc in the clockwise direction, so that the screwdriving means is moved into the screw plug unscrewing position and a new empty container with its screw plug is moved into the vicinity of the screwdriving means and aligned therewith.

2. An apparatus according to claim 1, wherein a recentering pin is mounted on the circumference of the measuring probe and said pin extends conically to the free end of the measuring probe and when said probe is moved into the container filling opening said pin engages therein, means for disengaging the alignment pulleys from the container periphery as said pin enters the opening so that the recentreing pin can displace the container and align the container on the supporting and centreing pulleys.

3. An apparatus according to claim 2, wherein a machine frame holds said filling means and the filling device is stationary on the machine frame at the position in which the container is filled, and further comprising a fulcrum, and a drive mechanism for moving the filling means about the fulcrum laterally out of the movement path of said device for fitting safety caps and said screwdriving means and swinging the filling device into the filling position.

4. An apparatus according to claim 1, wherein the work station comprises the screwdriving means for screwing in and unscrewing the plug, the device for fitting safety caps and the filling device, a re-centreing pin on the rotary disc, and a drive mechanism for vertically moving the re-centreing pin.

5. An apparatus according to claim 4, wherein a machine frame holds said filling means and the filling device is stationary on the machine frame at the position in which the container is filled, and further comprising a fulcrum, and a drive mechanism for moving the filling means about the fulcrum laterally out of the movement path of said device for fitting safety caps and said screwdriving means and swinging the filling device into the filling position.

6. An apparatus according to claim 1, wherein a machine frame holds said filling means and the filling device is stationary on the machine frame at the position in which the container is filled, and further comprising a fulcrum, and a drive mechanism for moving the filling means about the fulcrum laterally out of the movement path of said device for fitting safety caps and said screwdriving means and swinging the filling device into the filling position.

7. An apparatus according to claim 1, wherein the work station comprises the screwdriving means for screwing in and unscrewing the plug, the device for fitting safety caps and the filling device, a recentreing a re-centreing pin on the rotary disc vertically moving the re-centreing pin, and means for disengaging the alignment pulleys from the container periphery as the pin enters the opening so that the re-centreing pin can displace the container and align the container on the supporting and centreing pulleys.

* * * * *